US005171093A

United States Patent [19]

Iwamoto et al.

[11] Patent Number: 5,171,093

[45] Date of Patent: Dec. 15, 1992

[54] CONTROL SYSTEM FOR A DOT MATRIX PRINTER

[75] Inventors: Naohisa Iwamoto, Yokohama; Tadashi Nagano, Kawasaki; Syuhji Sugita, Yamato; Shin Yamashita, Fujisawa, all of Japan

[73] Assignee: International Business Machines Corporation, Armonk, N.Y.

[21] Appl. No.: 595,149

[22] Filed: Oct. 10, 1990

[30] Foreign Application Priority Data

Nov. 30, 1989 [JP] Japan ..... 1-309397

[51] Int. Cl.[5] ..... B41J 2/51

[52] U.S. Cl. ..... 400/121; 340/735; 395/110

[58] Field of Search ..... 400/120, 121, 124; 340/731, 735; 364/518, 519, 523; 395/105, 108, 109, 110

[56] References Cited

U.S. PATENT DOCUMENTS

| | | | |
|---|---|---|---|
| 4,415,286 | 11/1983 | Jennings | 400/121 |
| 4,447,882 | 5/1984 | Walz | 340/731 |
| 4,555,191 | 11/1985 | Gojo | 340/731 |
| 4,941,761 | 7/1990 | Ogawa et al. | 400/121 |
| 5,020,927 | 6/1991 | Niikawa | 400/121 |

FOREIGN PATENT DOCUMENTS

| | | | |
|---|---|---|---|
| 36965 | 10/1981 | European Pat. Off. . | |
| 160318 | 11/1985 | European Pat. Off. | 400/120 |
| 329369 | 8/1989 | European Pat. Off. | 400/120 |
| 116190 | 9/1981 | Japan | 400/121 |
| 141567 | 7/1985 | Japan | 400/121 |
| 22960 | 1/1986 | Japan | 400/121 |
| 212164 | 9/1987 | Japan | 400/121 |
| 56461 | 3/1988 | Japan | 400/121 |
| 67158 | 3/1988 | Japan | 400/121 |
| 120663 | 5/1988 | Japan | 400/121 |
| 159061 | 7/1988 | Japan | 400/121 |
| 241593 | 9/1989 | Japan | 340/731 |

OTHER PUBLICATIONS

H. E. Berkebile et al., "Draft-to-Text Font Conversion Algorithm"; *IBM TDB*; vol. 25, No. 10, pp. 5173-5174; Mar. 1983.

J. Kitamura; "Draft Font Generation"; *IBM TDB*; vol. 27, No. 4B, pp. 2504; Sep. 1984.

*Primary Examiner*—David A. Wiecking

*Attorney, Agent, or Firm*—John S. Gasper

[57] ABSTRACT

A printing apparatus having a printhead which is moved relative to a print medium in a print direction. The printhead has at least one print elements aligned in the print direction. A print control receives print data to perform print operations, including the printing of two horizontally adjacent dots, such as for characters having portions which include two adjacent vertical lines of dots. The print control controls the print operations to provide the printing of two horizontally adjacent dots in high speed print mode as well as normal speed mode.

6 Claims, 10 Drawing Sheets

HIGH SPEED PRINT MODE 2

HIGH SPEED PRINT MODE 2

NORMAL SPEED PRINT MODE

HIGH SPEED PRINT MODE 1

HIGH SPEED PRINT MODE 2

HIGH SPEED PRINT MODE 2

CONTROL SYSTEM FOR A DOT MATRIX PRINTER

DETAILED DESCRIPTION OF INVENTION

1. Field of Invention

The invention relates to a serial dot matrix printer which includes a dot matrix print head provided with at least two columns of dot print elements.

2. Prior art and problems

Serial dot matrix printers have been well known in the art in which a dot matrix print head including one column of dot print elements is moved in a print direction. The dot print elements are selectively activated against a print medium or paper to print characters or image. The printer has a normal speed print mode and a high speed print mode. FIGS. 8A and 8B show the results of print operations in the normal speed print mode and the high speed print mode of the prior serial dot matrix printer, respectively. The speed of the movement of the print head in the high speed print mode is two times as high as the speed in the normal speed print mode.

FIG. 9 shows print data for horizontal print positions P1 through P7 of the dot row 1 in the FIGS. 8A and 8B and the results of prior print operations in the normal speed print mode and the high speed print mode. The binary number 1 in the print data represents the activation of the dot print element, and the binary number 0 represents no activation of the dot print element. FIG. 10 shows print data for horizontal print positions P1 through P6 of the dot row 2 in the FIGS. 8A and 8B, and the results of print operations in the normal speed print mode and the high speed print mode. In the normal speed print mode, all the print positions are printed by the dot print element, as specified by the print data, and, in the high speed print mode, alternate print positions are printed, as shown in the FIGS. 8A, 8B, 9 and 10. The character "T" indicates a predetermined time period required by the print element to perform the next operation.

FIG. 11 shows a prior control circuit for performing the alternate print operations in the high speed print mode. When the print data 1 of the print position P1 in the FIG. 9 is processed, the data 1 is stored in a data latch 111 and supplied to one input of AND gate 112. Since the print operations of a preceding print position just before the print position P1 was not performed the content of a data latch 113 is the binary number 0, which is inverted to the binary number 1 by an inverter 114, whereby the AND gate 112 is conditioned and generates the binary number 1 on its output, so that the dot print wire is activated at the current print position P1 to print the dot. And, the binary number 1 is stored in the data latch 113. In the FIG. 11 (0) indicates the current print position and (−1) indicates the preceding print position. The operations proceed to the next print position P2, which is called now, as the current print position. The binary number 1 is stored in the data latch 111 and supplied to one input of the AND gate 112. Since the content of the data latch 113 is the binary number 0, the AND gate 112 is not conditioned, thereby the output of the AND gate 112 is the binary number 0, so that the dot print wire is not activated at the current print position P2. In this manner the results in the high speed print mode, as shown in the FIGS. 9 and 10 are obtained. Japanese patent application No. 59-87803, Published Unexamined Patent Application No. 60-230867, discloses the prior technology described above. The problems in the prior technology are that the two horizontally adjacent dots can not be printed in the high speed print mode. Most of the vertical lines and the slanting lines of the characters are represented by two horizontally adjacent dots. And, the reduction of the thickness of the vertical and slanting lines in the high speed print mode remarkably reduces the readability and clearness of the printed characters.

SUMMARY OF INVENTION

In accordance with the present invention, a printing apparatus is provided which prints two horizontally adjacent dots in the high speed print mode. The invention solves the problems in the prior technology, as stated hereinbefore. The invention realizes the printing of two horizontally adjacent dots in the high speed print mode.

A printing apparatus in accordance with the present invention includes a print head which is moved relative to a print medium in a print direction. The print head includes at least two print elements aligned in the print direction, and each of the print elements requires a predetermined time period to perform the next print operation. The printing apparatus also includes a print control means for receiving print data to perform the print operations at a current print position by the other of print elements when (a) the print data specifies the print operations at the current print position, (b) the print operations at one preceding print position just before the current print position were made by one of the print elements, (c) the predetermined time period of the other of the printing elements has been elapsed, and (d) the print data does not specify the print operations at predetermined print positions just after the current print position.

The print data specifies whether the print operations should be performed at the print positions. The printing apparatus operates in a normal speed print mode or the high speed print mode. In the normal speed print mode, each of the print elements performs print operations every other print position. It is assumed that the moving speed of the print head or the print elements relative to the print medium is Vcm/sec. In the high speed print mode, wherein the moving speed of the print head is 1.5 Vcm/sec. or 2.0 Vcm/sec., each of the print elements performs the print operations every three print positions when the moving speed is 1.5 Vcm/sec., and each of the print elements performs the print operations every four print positions when the moving speed is 2.0 Vcm/sec. N represents the number of print positions, not printed between the printed print positions. In other words, each of the print elements is capable of printing the dot at the print positions which are separated by the N print positions, which are not printed. The N is one when the moving speed is Vcm/sec., the N is two when the moving speed is 1.5 Vcm/sec., and the N is three when the moving speed is 2.0 Vcm/sec. That is, the N is positive integer 2 or 3 in the high speed print mode. The N is determined by the predetermined time period and the relative movement speed of the print head to the print medium.

The printing apparatus can print the dots at a high speed wherein the N is greater than 3. In this case, however, the dot density of the horizontal line of the character becomes low, though the two horizontally adjacent dots in the vertical line of the character are printed. It has been experimentally found that the high speed mode wherein the N is 2 or 3 realized the high quality print results.

The print control means receives the print data which specifies as to whether the print operations should be performed at the print positions, and performs the print operations at the current print position when (a) the print data specifies the print operations at the current print position, (b) the print operations at one preceding print position just before the current print position was performed by one of the print elements, (c) the print operations at N−1 print positions just before the preceding print position were not performed by the other of the print elements, that is, a predetermined time period T of the other of the print elements to perform the next print operations has elapsed, and (d) the print data does not specify the print operations at N−1 print positions just after the current print position.

The print head is a dot matrix print head which includes two columns of dot print elements, and two adjacent dot print elements in the two columns are aligned in the print direction.

The print control means includes a print decision means for storing the print data for the current print position, the print data for the N−1 print positions just after the current print position and the results of the print operations for the N print positions just before the current print position, to detect that the conditions (a), (b), (c) and (d) described hereinbefore are satisfied to generate a print actuation signal for the current print position. If the conditions (a), (b), (c) and (d) are satisfied, a dot is printed at the current print position by the other of the print elements.

DESCRIPTION OF EMBODIMENTS

Figure 1:
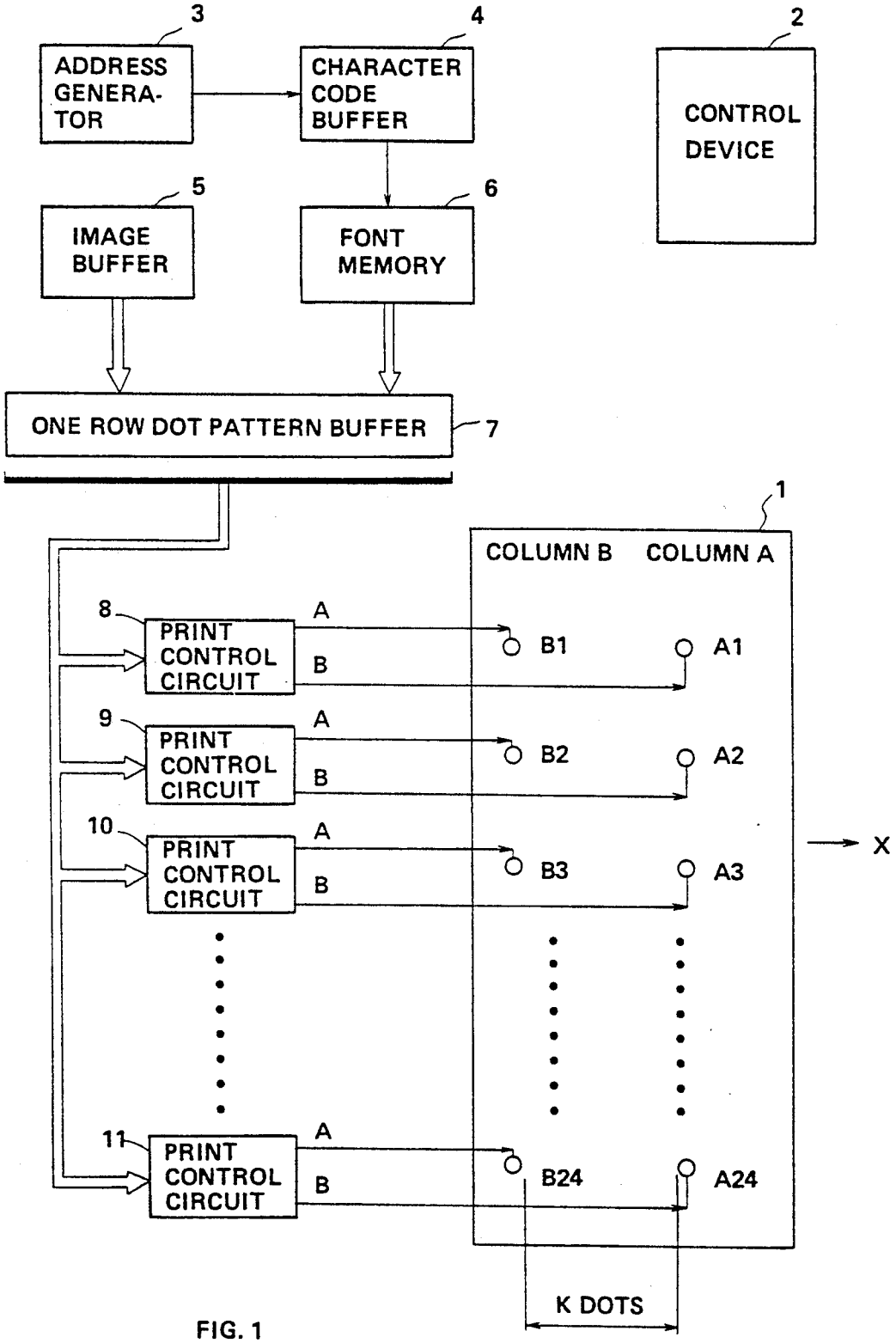
FIG. 1 shows the dot matrix print head and circuit blocks in accordance with the present invention.

FIG. 1 shows a dot matrix print head 1 and circuit blocks in accordance with the present invention. The print head 1 includes two dot print columns A and B. The column A includes dot print elements or print wires A1, A2, A3, . . . A24, and the column B includes dot print elements B1, B2, B3, . . . B24. In this embodiment, the print wires in each column are aligned in vertical direction to the print directions. The print head 1 is moved relative to a print medium or paper, not shown, in a print direction X or horizontal direction to print one character row on the print medium. The two print elements or wires A1 and B1 in the columns A and B are aligned in the print direction X. In other words, the print elements A1 and B1 print the dots on the same dot line. The remaining pairs of print elements A2 and B2, A3 and B2, . . . A24 and B24 are also aligned in the print direction X.

The distance between print elements of the column A and the print elements of the column B is K dots.

The dot matrix print head 1 also includes an actuator for actuating each print element, as described in U.S. patent application Ser. No. 285203, filed on Dec. 16, 1988, titled "Impact printer actuator using magnet and electromagnetic coil and method of manufacture," assigned to the same assignee as that of the present invention. The actuator in the print head 1, a mechanism for moving the print head, and a paper feed mechanism are well known in the art, and are not described.

The dot print element requires a predetermined time period T to perform the next print operation, since the print element is actuated by the mechanical actuator described above. Due to the time period T, every other print position is printed in the normal speed print mode, and every third or every fourth print position is printed in the high speed print mode.

Referring to FIGS. 4A, 4B, 4C and 4D, the print modes performed by the present invention are shown. In the FIGS. 4A, 4B, 4C and 4D, print positions represent the positions on the print media, and binary number 1 of print data specifies the print positions to be printed.

Figure 4A:
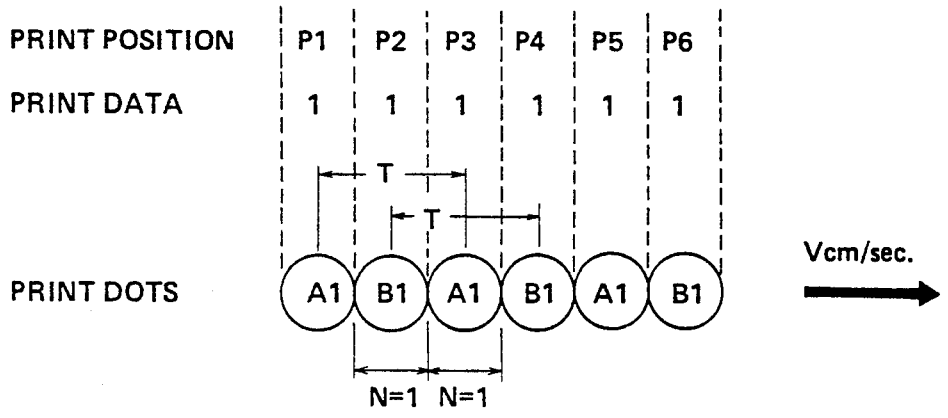
FIG. 4A, 4B, 4C and 4D show the print operations in accordance with the present invention.
Figure 4B:
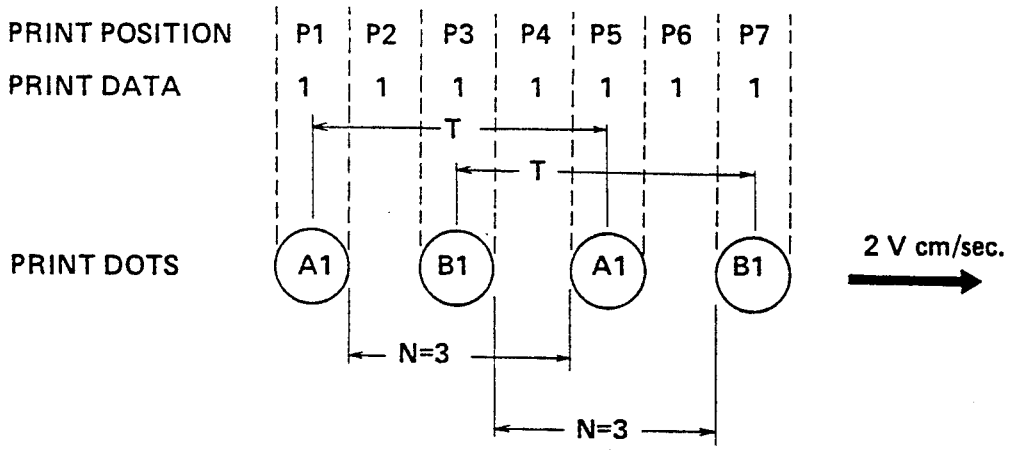
Figure 4C:
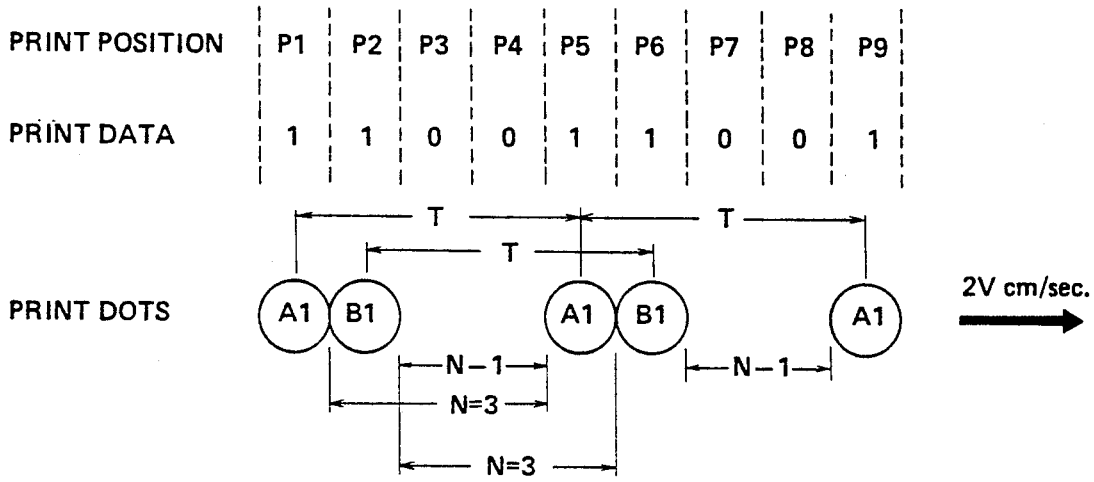

In the normal speed print mode, the print head 1 shown in the FIG. 1 is moved relative to the print medium at a velocity Vcm/sec., and the print head 1 is moved at a velocity 2 Vcm/sec. in the high speed print modes shown in the FIGS. 4B and 4C. The print data in the FIGS. 4A and 4B specifies that all the print positions should be printed by the dot print elements. In the FIGS. 4A, 4B, 4C and 4D, although only the operations of the dot print elements A1 and B1 in the two dot print columns A and B are described, the same operations are performed by the remaining print elements.

Figure 4D:
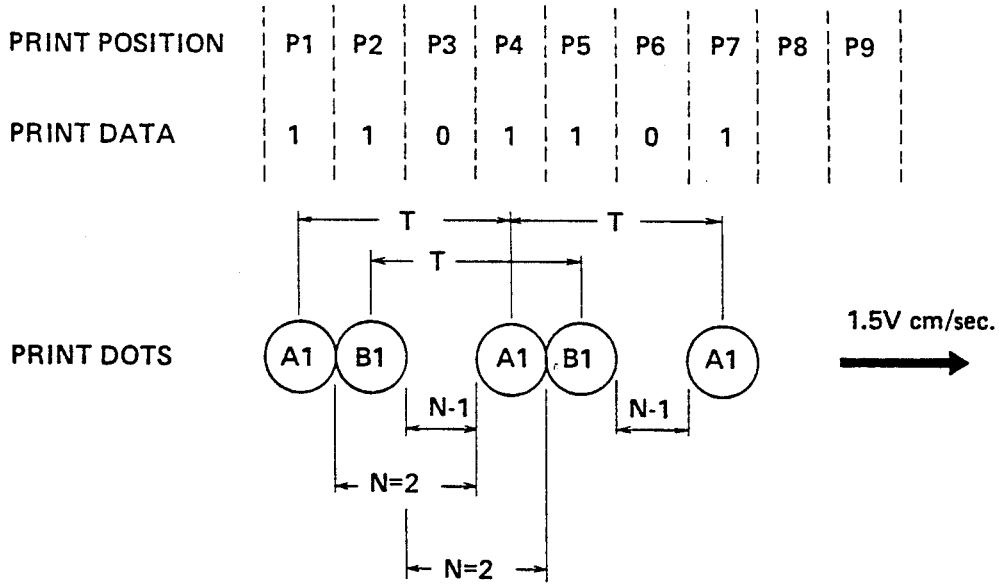
Figure 9:
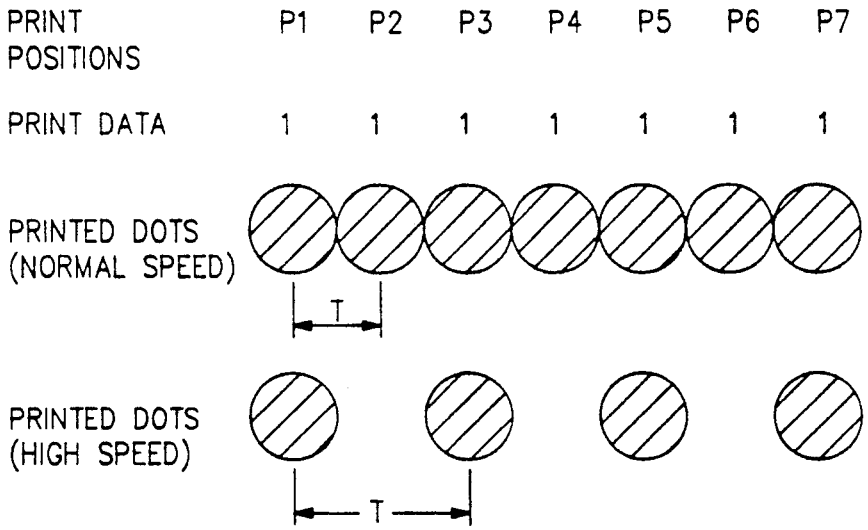
FIG.9 Prior Art
FIG. 9 and 10 show the dots printed by the print technology.
Figure 10:
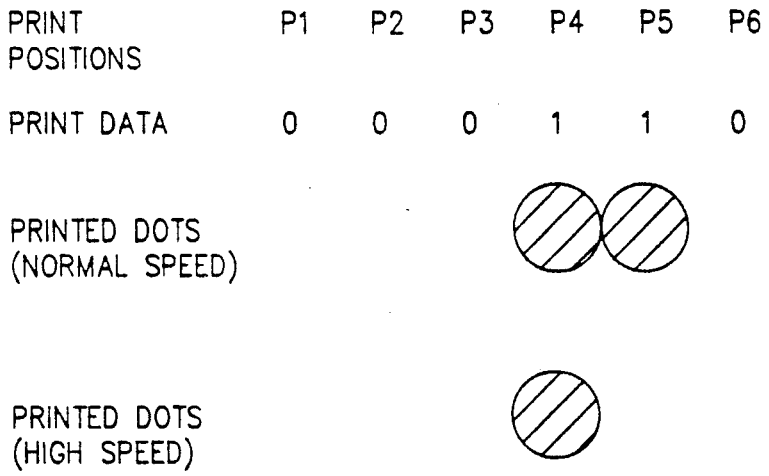
FIG.10 Prior Art

In the normal speed print mode of the FIG. 4A, the dot print element A1 of the column A prints the dots at the print-positions P1, P3 and P5, while the dot print element B1 of the column B prints the dots at the print positions P2, P4 and P6. In the high speed print mode 1 of the FIG. 4B, the dot print element A1 prints the dots at the print positions P1 and P5, and the dot print element B1 prints the dots at the print positions P3 and P7. The results of the print operations shown in the FIGS. 4A and 4B which are performed by the present invention using the print head 1 including the two dot print columns A and B are the same as that of the prior technology shown in the FIG. 9. The invention, however, realizes the remarkable print quality in the high speed print mode 2 shown in the FIGS. 4C and 4D, comparing to the prior print quality shown in the FIG. 10. The detail operations performing the print results shown in the FIGS. 4A, 4B, 4C and 4D are described hereinafter.

In the FIGS. 4A, 4B, 4C and 4D, N represents the number of print positions between the printed dots by the dot print element A1 or B1. That is, the two print elements A1 and B1 aligned in the print directions X are capable of printing the dots in print positions separated by N print positions, wherein N is a positive integer 2 or 3. In the high speed print mode 2 in the FIG. 4C, N=3. In the high speed print mode 2 shown in the FIG. 4D, N=2.

Referring to the FIG. 1, again, a control device 2, such as a microprocessor, controls the operations of the circuit blocks in the FIG. 1. Actually, a large number of control lines for controlling the operations of the blocks are connected between the control device 2 and the circuit blocks. For simplifying the drawing, however, the control lines are not shown. When the control device 2 starts the print operations, character codes of the characters of one page to be printed on the print medium are stored in storage locations of a character code buffer 4 specified by an address generator 3, under the control of the control device 2. The character codes in one character row are sequentially fetched from the character code buffer 4 to address a font memory 6, which stores character dot patterns. The character dot patterns in one character row are stored in one row dot pattern buffer 7. As a source of image, an image buffer 5 is provided. Image dot patterns can be also supplied to the one row dot pattern buffer 7. In the exemplary embodiment, one character row comprises 24 dot rows. The one row dot pattern buffer 7 stores data of the 24 dot rows. In the buffer 7, the dot pattern of the foreground character to be printed is represented by the binary number 1 and the dots of the background are represented by the binary number 0. The pattern of the binary numbers 1 and 0 in the buffer 7 is called as the print data, which specifies the print positions to be printed. The print data of the first dot row is supplied to a print control circuit 8, and the print data of the second, third and the 24th dot rows is supplied to the print control circuits 9, 10 and 11, respectively. It is noted that the print control circuits and the dot print elements for the fourth through the 23rd dot rows are not shown in the FIG. 1, and all the print control circuits have the same circuit configurations.

The operations in accordance with the present invention are described by reference to the print control circuit 8 and the dot print elements A1 and B1.

Figure 2:
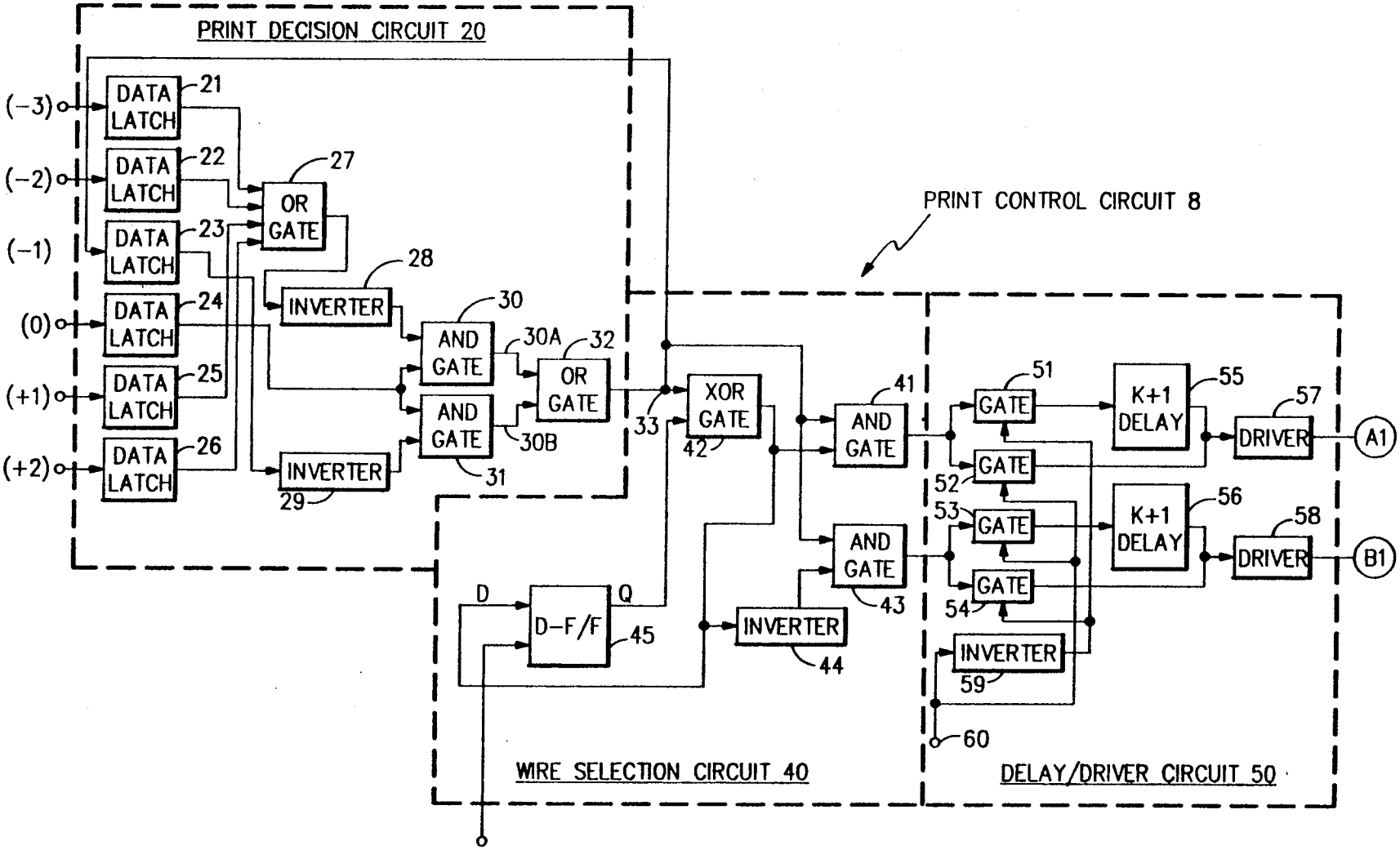
FIG. 2 shows the circuits of the print control circuit in accordance with the present invention.

The detail of the print control circuit 8 is shown in FIG. 2. The print control circuit 8 includes a print decision circuit 20, a wire selection circuit 40 and a delay/driver circuit 50.

The print decision circuit 20 is operated in the high speed print mode shown in the FIGS. 4B, 4C and 4D and not operated in the normal speed print mode shown in the FIG. 4A under the control of the control device 2.

Operations in the High Speed Print Modes 1 and 2 Shown in the FIGS. 4B and 4C In the high speed print modes 1 and 2, the print decision circuit 20 receives: the print data of the current print positions, which is shown as position (0) in the FIG. 2; the print data of the N−1 print positions, which are shown as positions (+1) and (+2) in the FIG. 2, just after the current print position; and the print results of the past N print positions, which are shown as positions (−1), (−2) and (−3) in the FIGS. 2, just before the current print position.

It is noted that N=3 in the embodiment, shown in the FIGS. 4B and 4C.

Figure 3:
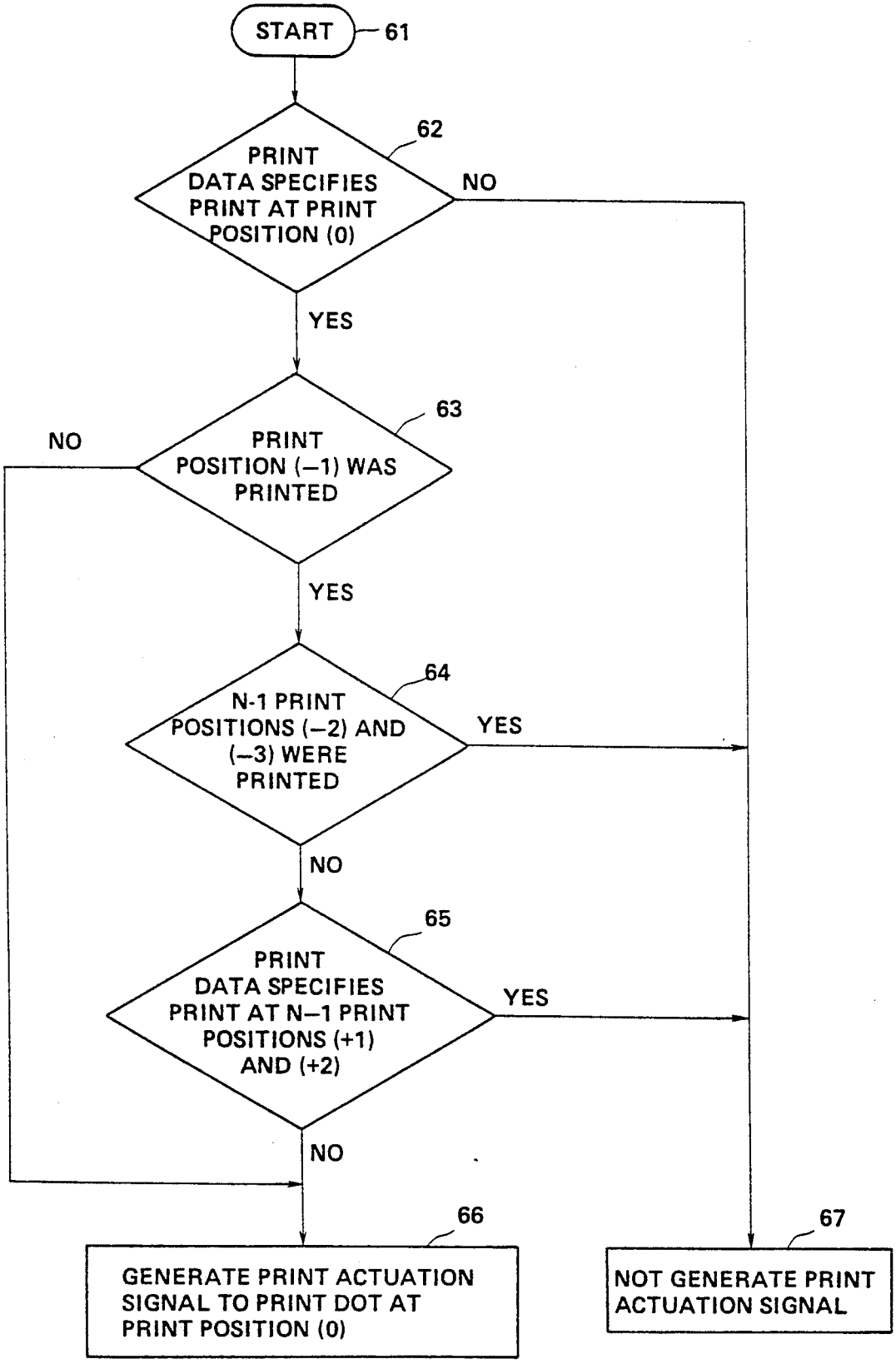
FIG. 3 shows the flow chart of the operations in accordance with the present invention.

Referring to FIG. 3, the operations performed in the high speed modes shown in the FIGS. 4B and 4C by the print decision circuit 20 are shown.

The operations start at a block 61. The operations proceed to a block 62 which determines as to whether the print data specifies the print of the dot at the current print position (0). If the answer of the block 62 is NO, the operations proceed to a block 67 and the circuit 20 does not generate a print actuation signal. The print actuation signal indicates that the print of the dot at the current position (0) should be performed. If the answer of the block 62 is YES, the operations proceed to a block 63 which determines as to whether the preceding one print position (−1) just before the current print position (0) was printed. If the answer of the block 63 is NO, the operations proceed to a block 66, and the print decision circuit 20 generates the print actuation signal to print the dot at the current print position (0). If the answer of the block 63 is YES, the operations proceed to a block 64 which determines as to whether the past N−1 print positions (−2) and (−3) just before the preceding one print position (−1) were printed. If the answer of the block 64 is YES, the operations proceed to the block 67, and the print operations at the current print position (0) are not performed. If the answer of the block 64 is NO, the operations proceed to a block 65 which determines as to whether the print data specifies the print operations at the next N−1 print positions (+1) and (+2) just after the current print position (0). If the answer of the block 65 is YES, the operations proceed to the block 67, and the print operations at the current print position (0) are not performed. If the answer of the block 65 is NO, the operations proceed to the block 66, and the print operations at the current print position (0) are performed.

Referring to the FIG. 2, the print decision circuit 20 includes data latches 21, 22, 23, 24, 25 and 26. The data latches 21, 22 and 23 store the print results of the past N print positions (−1), (−2) and (−3), the data latch 24 stores the print data of the current print position (0), and the data latches 25 and 26 store the print data of the next N−1 print position (+1) and (+2).

The output lines of the data latches 21, 22, 25 and 26 are connected to OR gate 27. The output line of the OR gate 27 is connected to an inverter 28, an output line of which is connected to one input of AND gate 30. The output line of the data latch 24 is connected to the other input of the AND gate 30 and one input of AND gate 31. The output line of the data latch 23 is connected to an inverter 29, an output line of which is connected to the other input of the AND gate 31. The output lines 30A and 30B of the AND gates 30 and 31 are connected to OR gate 32. The output line 33 of the OR gate 32 is connected to the data latch 23, AND gate 41 and Exclusive OR (XOR) gate 42. The data is shifted from the data latch 23 to the data latch 22 and the data latch 21 by dot clock pulses.

Describing the operations of the high speed print mode 1 shown in the FIG. 4B, it is assumed that the print operations are started at the print position P1 by the control device 2, and all the data latches have been reset or cleared.

In this mode, the print data is 1 1 1 1 1 . . . , and every other print position on the print media are printed by the dot print elements A1 and B1.

The print data 1 1 1 of the print positions P1, P2 and P3 are supplied to the data latches 24, 25 and 26. The contents of the data latches 21-26 are as follows.

Data latch 21 (−3): 0
Data latch 22 (−2): 0
Data latch 23 (−1): 0
Data latch 24 ( 0): 1
Data latch 25 (+1): 1
Data latch 26 (+2): 1

In this case, the output signal of the line 30A is the binary number 0 and the output signal of the line 31A is the binary number 1, so that the output signal of the OR gate 32 is the binary number 1 by which the dot print element is actuated. The binary number 1, i.e. print actuation signal, on the line 33 is stored in the data latch 23 and is also supplied to AND gate 41 and Exclusive OR gate (XOR) 42 in the wire selection circuit 40. The wire selection circuit 40 selects the print element A1 in this case, and the print actuation signal is supplied to a driver 57 in the delay/driver circuit 50, whereby the dot is printed at the print position P1 by the dot print element A1 as shown in the FIG. 4B.

Describing the above operations with reference to the FIG. 3, the answer of the block 62 is YES, and the answer of the block 63 is NO, whereby the print decision circuit 20 generates the print actuation signal on the output line 33, and the dot is printed at the current print position (0), i.e. the print position P1.

The operations of the wire selection circuit 40 and the delay/driver circuit 50 are described hereinafter.

In synchronism with the next dot clock pulse, the operations for the next print position P2 are initiated. The current print position (0) is the print position P2. The print data 1 1 1 of the print positions P2, P3 and P4 are supplied to the data latches 24, 25 and 26, and the contents of the data latch 23 have been replaced by the binary number 1 in the previous operations as follows.

Data latch 21 (−3): 0
Data latch 22 (−2): 0
Data latch 23 (−1): 1
Data latch 24 ( 0): 1
Data latch 25 (+1): 1
Data latch 26 (+2): 1

In this case, both the output signals on the lines 30A and 30B are the binary number 0, thereby the OR gate 32 does not generate the print actuation signal on the line 33, so that the dot is not printed at the current print position (0), i.e. the print position P2, as shown in the FIG. 4B. And, the binary number 1 in the data latch 23 is shifted to the data latch 22, and the new binary number 0 on the line 33 is stored in the data latch 23.

Describing the above operations with reference to the FIG. 3, the answer of the block 62 is YES, the answer of the block 63 is YES, the answer of the block 64 is NO, and the answer of the block 65 is YES, whereby the print decision circuit 20 does not generate the print actuation signal on the output line 33, and the dot is not printed at the print position P2.

In synchronism with the next dot clock pulse, the operations for the next print position P3 are initiated. The print data 1 1 1 of the print positions P3, P4 and P5 are supplied to the data latches 24, 25 and 26. The contents of the data latches 21–26 are as follows.

Data latch 21 (−3): 0
Data latch 22 (−2): 1
Data latch 23 (−1): 0
Data latch 24 ( 0): 1
Data latch 25 (+1): 1
Data latch 26 (+2): 1

In this case, the signal on the line 30A is the binary number 0 and the signal on the line 30B is the binary number 1, whereby the OR gate 32 generates the print actuation signal on the line 33. The signal is supplied to the data latch 23 and the wire selection circuit 40, which selects the dot print element B1, as described hereinafter. The print actuation signal is supplied to the delay/driver circuit 50, whereby a driver 58 actuates the dot print elements B1 to print the dot at the current print position (0), i.e. the print position P3, as shown in the FIG. 4B.

Describing the above operations with reference to the FIG. 3, the answer of the block 62 is YES, and the answer of the block 63 is NO, whereby the print decision circuit 20 generates the print actuation signal on the output line 33, and the dot is printed at the current print position (0), i.e. the print position P3.

The operations for the succeeding print positions P4, P5, P6, . . . are performed in the same manner as described above, and the dots are printed at the print positions P5 and P7, as shown in the FIG. 4B.

Figure 5A:
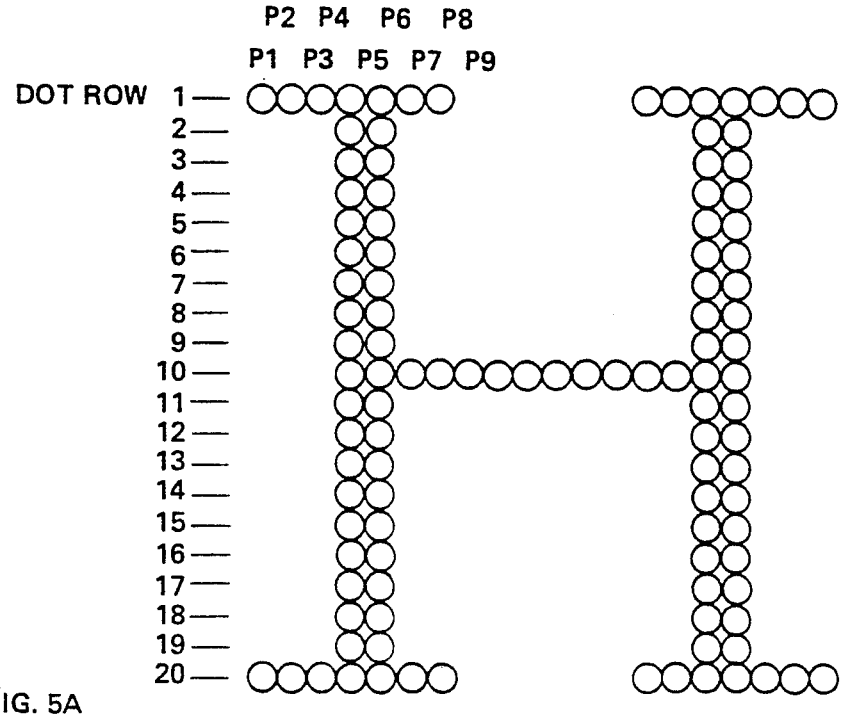
FIG. 5A and 5B show the printed dots in accordance with the present invention.
Figure 5B:
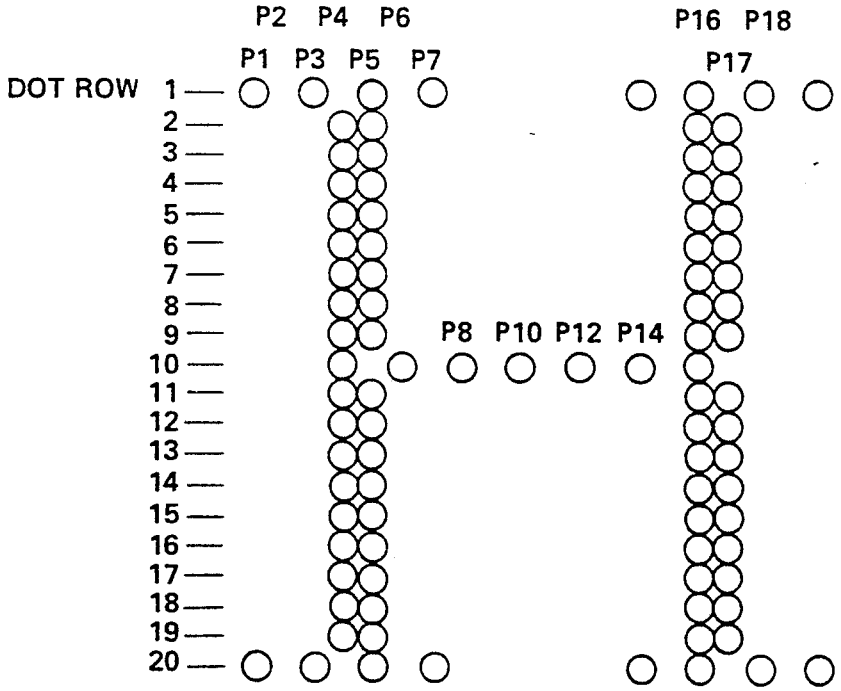

The above high speed print mode 1 prints the print positions P1, P3, P5 and P7 in the dot row 1 and the print positions P4, P6, P8, P10, P12, P14 and P16 in the dot row 10 in FIG. 5B for example.

Describing the high speed print mode 2 shown in the FIG. 4C, it is assumed that the print operations are started at the print position P1 by the control device 2, and all the data latches have been cleared.

In this mode, the print decision circuit 20 prints the dot on the print medium when the conditions (a), (b), (c) and (d) described hereinbefore are satisfied, so that the two horizontally adjacent dots are printed. More particularly, the print decision circuit 20 prints the two horizontally adjacent dots when the print 1 1 0 0 1 1 0 0 . . . is supplied.

The print data 1 1 0 of the print positions P1, P2 and P3 are supplied to the data latches 24, 25 and 26. The contents of the data latches 21–26 are as follows.

Data latch 21 (−3): 0
Data latch 22 (−2): 0
Data latch 23 (−1): 0
Data latch 24 ( 0): 1
Data latch 25 (+1): 1
Data latch 26 (+2): 0

The binary numbers 0 in the data latch 21, 22 and 23 indicate that the past N, i.e. three in this mode, print positions have not been printed.

In this case, the output signal on the line 30A is the binary number 0 and the output signal on the line 30B is the binary number 1, so that the print actuation signal, i.e. the binary number 1, is generated on the line 33. The binary number 1 is supplied to the data latch 23 and the wire selection circuit 40 which selects the dot print element A1, and the print actuation signal is supplied to the driver 57, whereby the dot is printed at the current print position, i.e. the print position P1, by the dot print element A1, as shown in the FIG. 4C.

Describing the above operations with reference to the FIG. 3, the answer of the block 62 is YES and the answer of the block 63 is NO, whereby the dot is printed at the current print position (0), i.e. the print position P1.

The operations for the next print position P2 are initiated in synchronism with the next dot clock pulse.

The print data 1 0 0 of the print positions P2, P3 and P4 are supplied to the data latches 24, 25 and 26. The binary number 1 has been stored in the data latch 23. The contents of the data latches 21–26 are as follows.

Data latch 21 (−3): 0
Data latch 22 (−2): 0
Data latch 23 (−1): 1
Data latch 24 ( 0): 1
Data latch 25 (+1): 0
Data latch 26 (+2): 0

In this case, the output signal on the line 30A is the binary number 1 and the output signal on the line 30B is the binary number 0, and that the output signal of the OR gate 32 is the binary number 1, i.e. the print actuation signal. The binary number 1 is supplied to the data latch 23 and the wire selection circuit 40, which selects the dot print elements B1. The print actuation signal is supplied to the delay/driver circuit 50, whereby the driver 58 actuates the dot print element B1 to print the dot at the current print position (0), i.e. the print position P2, as shown in the FIG. 4C.

Describing the above operations with reference to the FIG. 3, the answer of the block 62 is YES, the answer of the block 63 is YES, the answer of the block 64 is NO, and the answer of the block 65 is NO, whereby the print decision circuit 20 generates the print actuation signal on the output line 33, and the dot is printed at the current print position (0), i.e. P2.

It is noted that, in this case, all the following conditions are satisfied.

(a) The print data specifies the print of the dot at the current print position (0).
(b) The preceding one print position (−1) just before the current print position (0) was printed.
(c) The N−1 print positions (−2) and (−3) just before the preceding one print position (−1) were not printed, and
(d) The print data does not specify the print operations at the next N−1 print positions (+1) and (+2) just after the current print position (0).

It is apparent that the print decision circuit 20 prints the dot at the print position P2 when the above conditions are satisfied, so that the two horizontally adjacent dots are printed. Comparing to the high speed print mode of the prior technology described hereinbefore, the prior technology using the single dot column can not print the horizontally adjacent two dots, as shown in the FIG. 10. That is, the dot at the print position P4 is printed, while the dot is not printed at the next print position P5 in the FIG. 10.

Referring to the FIG. 4C, again, the operations for the next print position P3 are initiated in synchronism with the next dot clock pulse.

The print data 0 0 1 of the print positions P3, P4 and P5 are supplied to the data latches 24, 25 and 26. The contents of the data latches 21–26 are as follows.

Data latch 21 (−3): 0
Data latch 22 (−2): 1
Data latch 23 (−1): 1
Data latch 24 ( 0): 0
Data latch 26 (+2): 1

In this case, the output signals on both the lines 30A and 30B are the binary number 0, so that the output signal on the line 33 is the binary number 0, that is, the print actuation signal is not generated, and the dot is not printed at the current print position (0), i.e. P3. The binary number 0 is supplied to the data latch 23, and the previous contents in the data latches 23 and 22 are shifted to the data latches 22 and 21, respectively.

Describing the above operations with reference to the FIG. 3, the answer of the block 62 is NO, so that the dot is not printed, at the current print position (0), i.e. P3.

The operations for the next print position P4 are initiated in synchronism with the next dot clock pulse.

The print data 0 1 1 of the print positions P4, P5 and P6 are supplied to the data latches 24, 25 and 26. The contents of the data latches 21–26 are as follows.

Data latch 21 (−3): 1
Data latch 22 (−2): 1
Data latch 23 (−1): 0
Data latch 24 ( 0): 0
Data latch 25 (+1): 1
Data latch 26 (+2): 1

In this case, the output signals on both the lines 30A and 30B are the binary number 0, so that the binary number 1, i.e. the print actuation signal is not generated by the OR gate 32, whereby the dot is not printed at the current print position (0), i.e. P4. The binary number 0 is supplied to the data latch 23 and the previous data in the data latches 23 and 22 are shifted.

Figure 6:
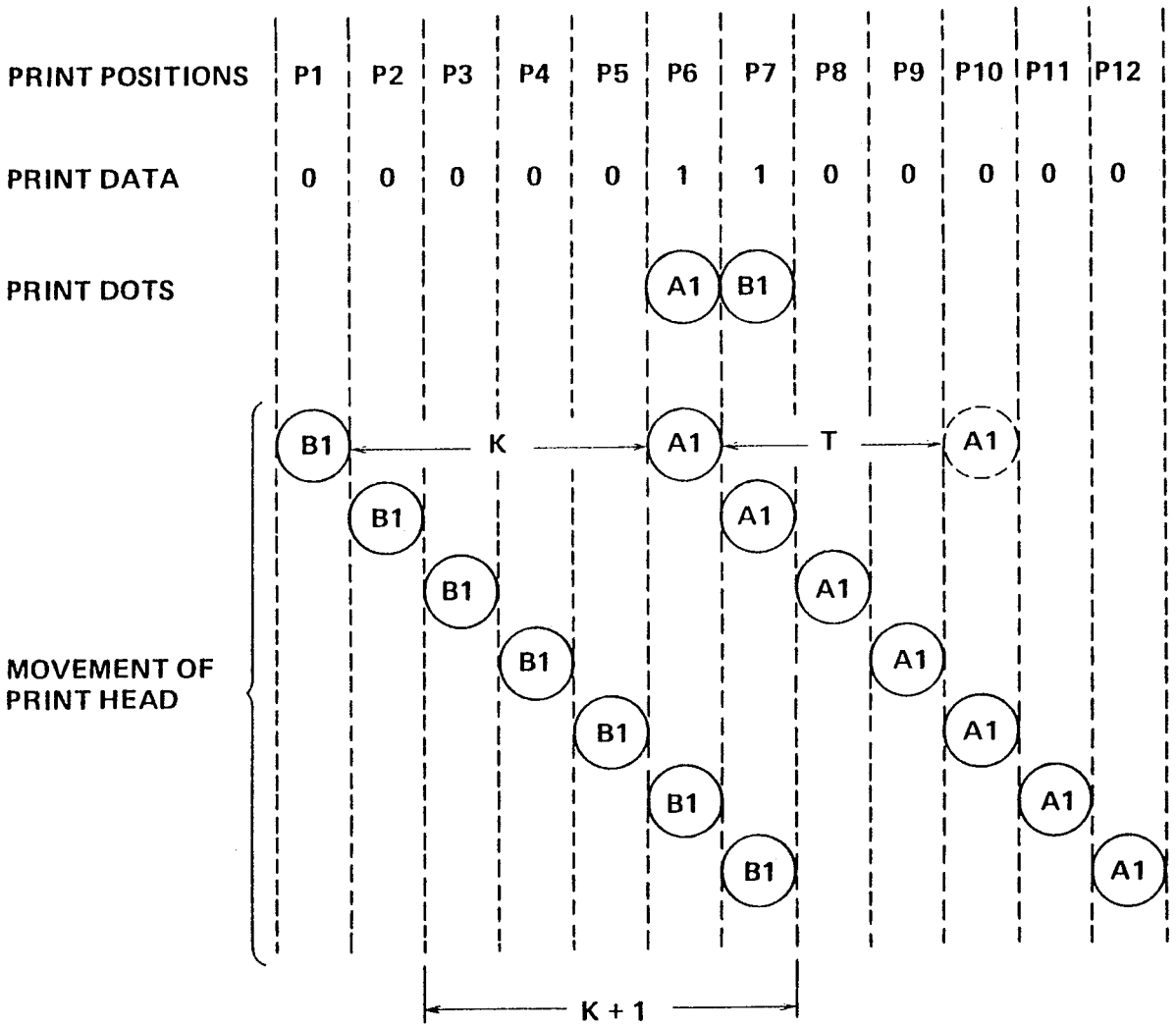
FIG. 6 shows the delay operations in the print operations.

Describing the above operations with reference to the FIG. 6, the answer of the block 62 is NO, so that the dot is not printed at the current print position P4. The operations of the next print positions P5 and P6 are the same as the operations of the print positions P1 and P2.

That is, at the print position P5, the answer of the block 62 in the FIG. 3 is YES, and the answer of the block 63 is NO, so that the dot is printed at the print position P5 by the dot print element A1. At the print position P6, the answer of the block 62 is YES, the answer of the block 63 is YES, the answer of the block 64 is NO, and the answer of the block 65 is NO, so that the dot is printed at the print position P6 by the dot print element B1. It is noted that all the conditions (a), (b), (c) and (d) are satisfied at the print position P6.

Describing the reasons for printing the dot when all the conditions are satisfied, it is noted that the print elements A1 and B1 require the time period T to perform the next print operations. That is, the N blank print positions, N=3 in the exemplary embodiment are required to print the next dot. When the print data specifies the print of the current print position P6, the preceding one print position P5 was printed, and the N−1 print positions, i.e. P3 and P4, just before the preceding one print position P5 were not printed, so that the print element B1 is capable of printing the dot at the current print position P6. But, whether the current print position P6 is printed is determined by the print data of the next N−1 print positions, i.e. P7 and P8. If the print data indicates that the print position P7 or P8 should be printed, the print element B1 should be used to print the dot at the position P7 or P8, so that the print element B1 should not be actuated at the current print position P6. From the reasons above, the current print position P6 is printed when all the conditions (a), (b), (c) and (d) are satisfied.

Referring to the FIGS. 5A and 5B, the FIG. 5A shows the printed results in the normal speed print mode and the FIG. 5B shows the printed results in the high speed print modes 1 and 2 in accordance with the present invention. The dot rows 1, 10 and 20 in the FIG. 5B are printed by the high speed print mode 1 shown in the FIG. 4B, and the remaining dot rows in the FIG. 5B are printed by the high speed print mode 2 shown in the FIG. 4C. Comparing the printed results of the present inventions to that of the high speed print mode of the prior art shown in the FIG. 6B, the vertical portions of the character H are printed by one vertical dot column in the prior art in the FIG. 6B, while, in the present invention, the most of the vertical portions of the character H except the dot rows 1, 10 and 20 are printed by the two vertical dot columns P4 and P5, and P15 and P16.

The high speed print mode 2 in accordance with the present invention realizes substantially the same printed results on the vertical lines or portions of the characters as that printed in the normal speed print mode shown in the FIG. 5A.

Operations in the High Speed Print Mode 2 Shown in the FIG. 4D

The FIG. 4D shows the operations of the high speed print mode 2 wherein the relative moving speed of the print head 1 to the print medium is 1.5 Vcm/sec., and N=2.

In the embodiment of this mode, the number of previous and future or next print positions is modified, due to N=2. That is, the print position (−2) is determined as the N−1 print positions just before the preceding print position (−1) in the condition (c), and the print position (+1) is determined as the next N−1 print position in the condition (d), so that the data latches 21 and 26 in the FIG. 2 are not used in this mode. And, the block 64 in the FIG. 3 determines as to whether the N−1 print position (−2) just before the preceding one print position (−1) was printed, or not, and the block 65 determines as to whether the print position (+1) just after the current print position (0).

Except the above modifications, the operations in this mode wherein N=2 are the same as that of the mode 2 shown in the FIG. 4C, and perform the print of the two horizontally adjacent dots, as shown in the FIG. 4D, hence the detailed operations are not described.

Operations in the Normal Speed Print Mode Shown in the FIG. 4A

In this mode, the print decision circuit 20 is not operated. In this mode, the print data is directly supplied to the line 33 which is the input of the wire selection circuit 40, under the control of the control device 2.

Describing the operations of the wire selection circuit 40 shown in the FIG. 2, the circuit 40 alternately selects the dot print element A1 or B1 when the print actuation signal is generated on the output line 33 of the OR gate 32 of the print decision circuit 20. The wire selection circuit 40 includes the AND gates 41 and 43, the Exclusive OR (XOR) gate 42, the inverter 44 and the D flip-flop (D-F/F) 45. It is assumed that the D-F/F 45 generates the binary number 0 on an output Q, which is connected to one input of the XOR gate 42.

When the print decision circuit 20 generates the binary number 1, i.e. the print actuation signal, at the print position P1 on the output line 33, the XOR gate 42 generates the binary number 1, so that the AND gate 41 generates the binary number 1, while the AND gate 43 is not conditioned, whereby the print actuation signal is supplied to the gates 51 and 52 of the dot print element A1, and the element A1 is actuated. The binary number 1 on the output of the XOR gate 42 is supplied to the input D of the D-F/F 45 along with the dot clock, so that the output of the D-F/F is switched to the binary number 1.

When the print decision circuit 20 generates the binary number 1 at the print position P2, both the input signals of the XOR gate 42 are the binary number 1, so that the AND gate 41 is not conditioned, while both the input signals of the AND gate 43 are the binary number 1, whereby the AND gate 43 is conditioned, the print actuation signal is supplied to the gates 53 and 54 of the dot print element B1, and the element B1 is actuated. And, the binary number 0 on the output of the XOR gate 42 is supplied to the D-F/F 45, so that the output Q is switched from the binary number 1 to the binary number 0.

When the print actuation signal is not generated by the print decision circuit 20 at the print positions P3 and P4, both the AND gates 41 and 43 are not conditioned, so that the print elements A1 and B1 are not actuated.

When the print actuation signal is generated by the print decision circuit 20 at the print position P5, the output of the D-F/F 45 is the binary number 0, so that the same operations as that in the case of the print position P1 are performed, and the print element A1 is actuated. The same operations as that of the print position P2 are performed at the print position P6, so that the print element B1 is actuated at the print position P6.

Describing the operations of the delay driver circuit 50, the circuit 50 includes the gates 51, 52, 53 and 54, the delay circuits 55 and 56, the drivers 57 and 58, and the inverters 59. FIG. 6 shows the delay operations of the print of dot by the dot print elements. It is assumed that the print head 1 in the FIG. 1 is moved from the left to the right on the print paper. The K represents the distance or the number of print positions between the print elements A1 and the print element B1. It is assumed that the print data indicates the print of dot at the print positions P6 and P7, and the dots are printed at the print positions P6 and P7, as shown in the FIG. 6. When the current print position (0) is the print position P6, the print decision circuit 20 generates the print actuation signal on the output line 33, and the print element A1 is positioned at the current print position P6 at this moment, so that the dot is printed at the print position P6 by the print element A1. It is noted that the print of the dot by the print element A1 is performed without any delay.

The print operations proceed to the next print position and the print head is advanced by one print position, as shown in the FIG. 6 at which the current print position is the print position P7. The print decision circuit 20 generates the print actuation signal on the output line 33. The dot at the print position P7 must be printed by the print element B1. However, the print element A1 is positioned at the print position P7, and the print element B1 is positioned at the print position P2 at this moment, and the print element A1 can not print the dot at the print position P7 since it requires the time period T to perform the next print operations. The actuation of the print element B1 must be delayed by K+1 print positions to print the dot at the print position P7, as shown in the FIG. 6.

Referring to the FIG. 2, again, when the print head 1 is moved from the left to the right, the binary number 1 is applied to the input terminal 60. The binary number 1 activates the gate 52 and the gate 53, while the gates 51 and 54 are closed, whereby the print actuation signal to the dot print element A1 is supplied to the driver 57 without delay, while the print actuation signal to the dot print element B1 is delayed by the K+1 delay circuit 56 to perform the delayed print operations.

The binary number 0 is supplied to the input terminal 60 when the print head 1 is moved from the right to the left, so that the print element B1 is actuated without delay, while the print element A1 is actuated with the K+1 delay. In this manner, the bi-directional print operations are performed.

Figure 7:
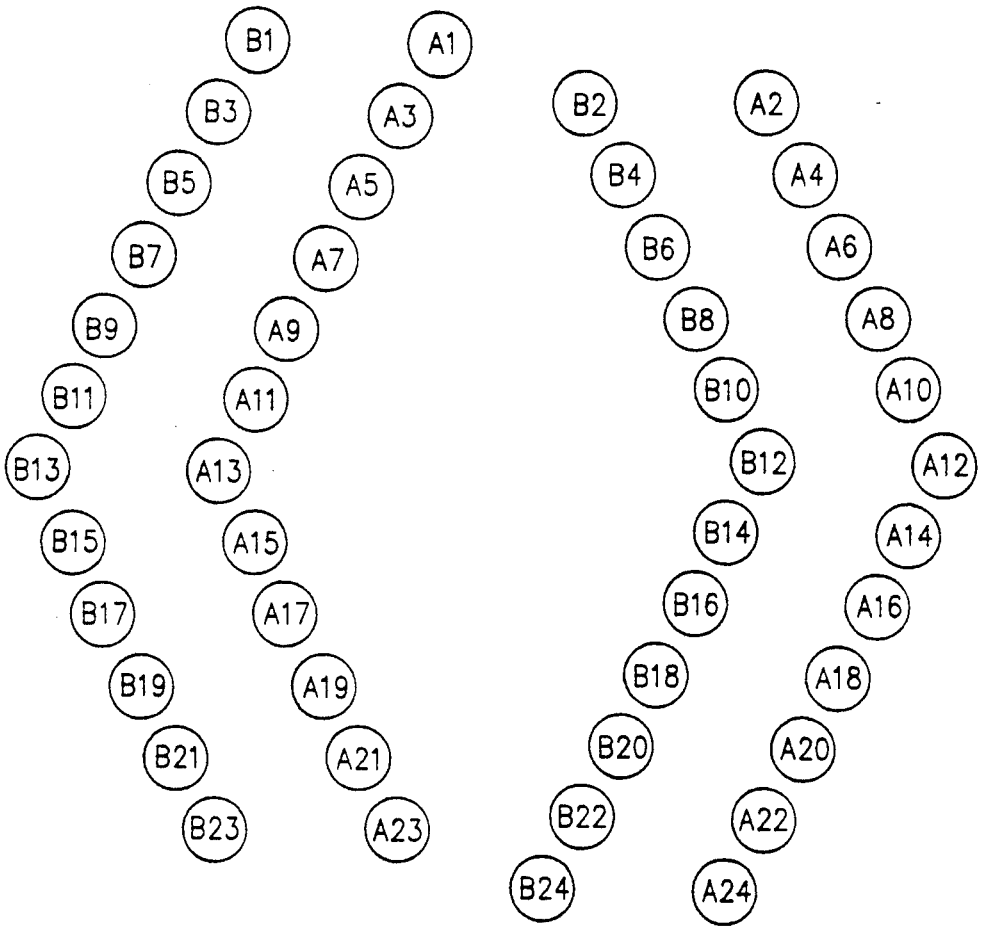
FIG. 7 shows a modified arrangement of the dot print elements.
Figure 11:
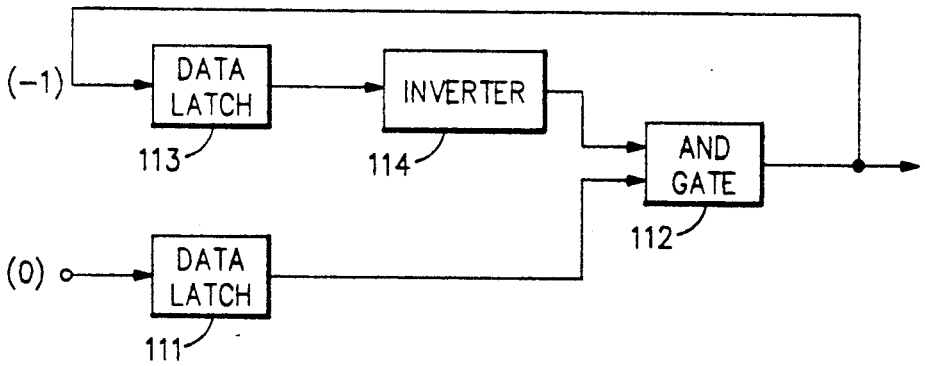
FIG.11 Prior Art
FIG. 11 shows the circuit of the prior technology.
Figure 8A:
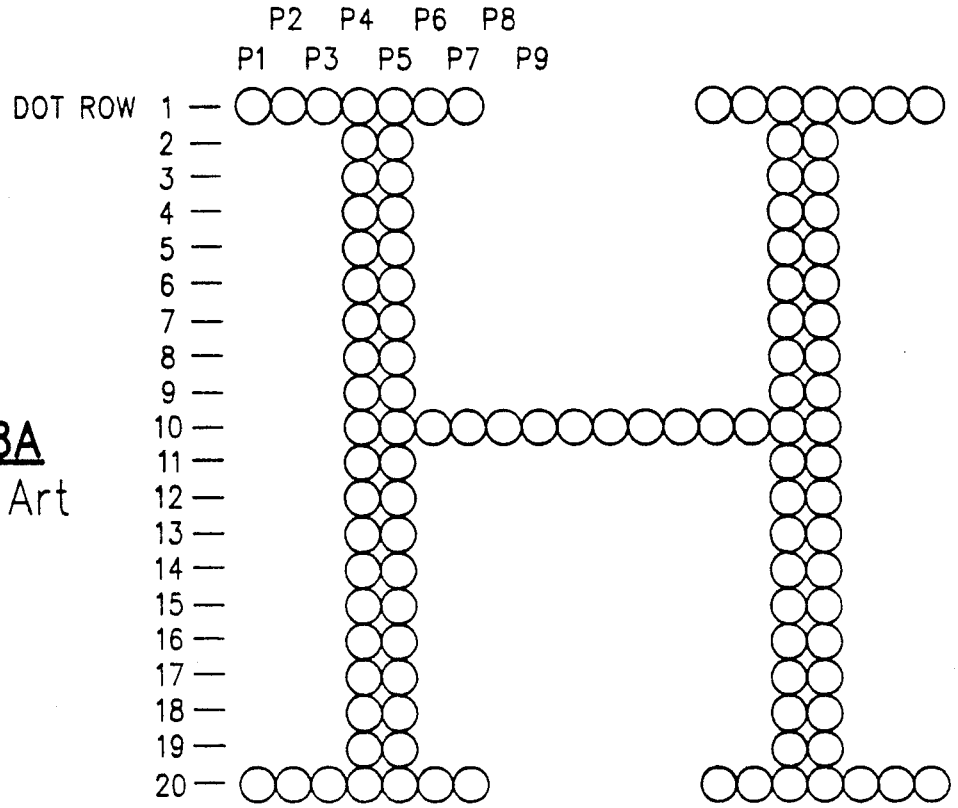
FIG.8A Prior Art
FIGS. 8A and 8B show the dots printed by the prior technology.
Figure 8B:
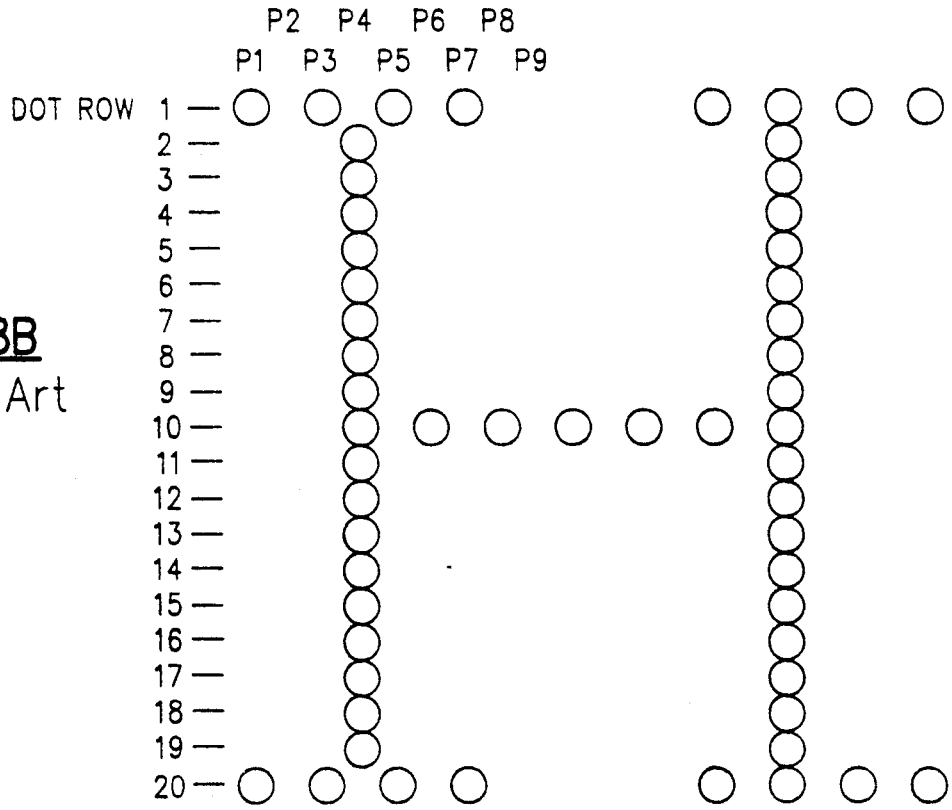
FIG.8B Prior Art

FIG. 7 shows a modified pattern of the dot print elements A1–A24 and B1–B24. The print elements are arranged into double diamond shaped pattern. In this arrangement, additional delays are required due to the inclination of the columns. The circuits for providing the additional delay are well known in the art, and the details of the circuits are not described.

Although the operations shown in the FIG. 3 are performed by the hardware type print decision circuit 20 shown in the FIG. 2, the operations can be performed by a microprocessor.

Although the invention has been described by using the embodiment of the wire dot printer, the invention can be used in an ink jet printer, a thermal transfer printer, a thermal dot printer, etc.

We claim:

1. Printing apparatus comprising:

a print head moved relative to a print medium in a print direction including at least two print elements aligned in said print direction wherein each of said print elements requires a predetermined time period to perform next print operations, and a print control means for receiving print data to perform the print operations at a current print position by one of the print elements when (a) said print data specifies the print operations at said current print position, (b) the print operations at a preceding print position just before said current print position were made by one of said print elements, (c) said predetermined time period of the other print elements has elapsed, and (d) said print data does not specify the print operations at predetermined print positions just after said current print position.

2. Printing apparatus according to claim 1, wherein said print data specifies as to whether the print operations should be performed at said print positions.

3. Printing apparatus comprising:

a print head moved relative to a print medium in a print direction including at least two print elements aligned in said print direction, each of said print elements being capable of printing at print positions separated by N print positions (N being a positive integer equal to 2 or 3), and a print control means for receiving print data to perform print operations at a current print position when (a) said print data specifies the print operations at said current print position, (b) the print operations at a preceding print position just before said current print position were made, (c) the print operations at N−1 print positions just before said preceding print position were not made, and (d) said print data does not specify the print operations at N−1 print positions just after said current print position.

4. Printing apparatus according to claim 3, wherein said print data specifies as to whether the print operations should be performed at said print positions.

5. Printing apparatus according to claim 3, wherein said print head is a dot matrix print head which includes two columns of dot print elements with two adjacent dot print elements of each column being aligned in said print direction.

6. Printing apparatus according to claim 3, wherein said print control means includes a print decision means for storing said print data for said current print position, said print data for N−1 print positions just after said current print position and the results of the print operations for N print positions just before said current print position, to detect that said conditions (a), (b), (c) and (d) are satisfied, to generate a print actuation signal for said current print position.

* * * * *